United States Patent [19]

Kirkham, Jr.

[11] 4,212,496

[45] Jul. 15, 1980

[54] CUSHION FOR SKI LIFT CHAIR

[76] Inventor: Arthur J. Kirkham, Jr., 9381 Peacock Dr., Sandy, Utah 84070

[21] Appl. No.: 895,862

[22] Filed: Apr. 13, 1978

[51] Int. Cl.[2] ..... A47C 27/00

[52] U.S. Cl. ..... 297/226; 297/219

[58] Field of Search ..... 5/353.1, 354; 247/218, 247/219, 226, 229, 250, 252, 457

[56] References Cited

U.S. PATENT DOCUMENTS

| | | | |
|---|---|---|---|
| 2,809,692 | 10/1957 | Taffae | 297/218 X |
| 2,860,691 | 11/1958 | Chesar | 297/218 X |
| 3,025,104 | 3/1962 | Murphy | 297/218 |
| 3,266,545 | 8/1966 | Kruissink | 297/219 X |
| 3,586,370 | 6/1971 | Barecki et al. | 297/219 |
| 3,596,989 | 8/1971 | Van Ryn et al. | 297/219 |

FOREIGN PATENT DOCUMENTS

| | | | |
|---|---|---|---|
| 854850 | 1/1940 | France | 297/226 |

*Primary Examiner*—James C. Mitchell

*Attorney, Agent, or Firm*—Criddle & Western

[57] ABSTRACT

A detachable cushion for the seat of ski lift chairs. A long, flat bar inserted into a pocket at one end of a seat pad is adapted to hook over the front edge of a conventional ski lift seat when the cushion is placed on the seat and, a rod sewn into a flap on the other end of the pad acts as a connector for springs which are adapted to hook to structure on the underside of the seat to hold the cushion tight.

1 Claim, 3 Drawing Figures

CUSHION FOR SKI LIFT CHAIR

BRIEF DESCRIPTION OF THE INVENTION

1. Field of the Invention

This invention relates to detachable cushions for use with ski lift chairs.

2. Prior Art

Cushions and covers for seats of various types are in common use and it has been known in the past to use such cushions and covers with ski lift chairs. To the best of my knowledge, however, there has not heretofore been a suitable cushion that can be readily installed and replaced and that will fit tautly over chair seats. The cushion of the present invention is usable on most conventional ski lift chairs, is easily replaced and since snow does not readily stick to it, it provides for easy cleaning and requires less brushing during use to keep snow off.

SUMMARY OF THE INVENTION

It is a principal object of the present invention to provide a detachable cushion that may be easily installed and replaced on most conventional ski lift chairs.

Other objects of the present invention are to provide a cushion to which snow does not easily stick and which may be easily cleaned.

Still other objects are to provide a cushion with a smooth surface for easy mounting and dismounting by riders, which is inexpensive to make form existing materials and which requires little maintenance.

Yet other objects are to provide a cushion having a fully tensioned pad, but one that does not utilize laces, loops, grommets or other attachment means that require a great deal of labor to construct and that can be easily torn loose or worn out. In addition, it is desired that the tensioning means used apply a uniform tension over the entire cushion surface so that the wear resulting from such tensioning is distributed evenly on the pad, and to provide tensioning means that will readily allow for reversal of the cushion so that both sides thereof can be used as wear surfaces.

Principal features of the present invention in a cushion for the seats of ski lift chairs include its construction utilizing a flat pad of a resilient material such as foam rubber sandwiched between layers of a slick, durable and flexible sheet material, such as vinyl. The cushion thus formed has a width approximately corresponding to that of conventional ski lift chairs. At one end of the cushion a pocket is sewn into the cushion with the pocket thus formed extending essentially the full width of a ski lift chair and a flat bar is positioned to extend the full width of the end of the pocket. At the opposite end of the cushion, the width is reduced slightly and a flap projects a short distance beyond the vinyl covered pad portion. A substantially rigid rod is sewn into the end of the flap and openings are provided in the flap to expose portions of the rod, to which portions of springs are attached.

The vinyl covered pad is attached to the seat of a ski lift chair by hooking the pocket over the front edge of the seat such that the metal bar will provide a solid surface beneath the seating surface that will securely anchor the pocket to the seat. The cushion is positioned to cover the seat, with the flap then extending over the back of the seat before being folded over the back edge of the seat, and beneath the seat to be hooked by springs to slats underneath the seat.

Additional objects and features of the invention will become apparent from the following detailed description and claims, taken together with the accompanying drawings.

THE DRAWINGS

In the drawing:

FIG. 1 is a perspective view of the cushion of the present invention, taken from slightly above and at one corner and with the cushion in place on a ski lift chair;

FIG. 2, an enlarged vertical sectional view taken along the line 2—2 of FIG. 1; and FIG. 3, a top plan view of the cushion.

DETAILED DESCRIPTION

Figure 1:
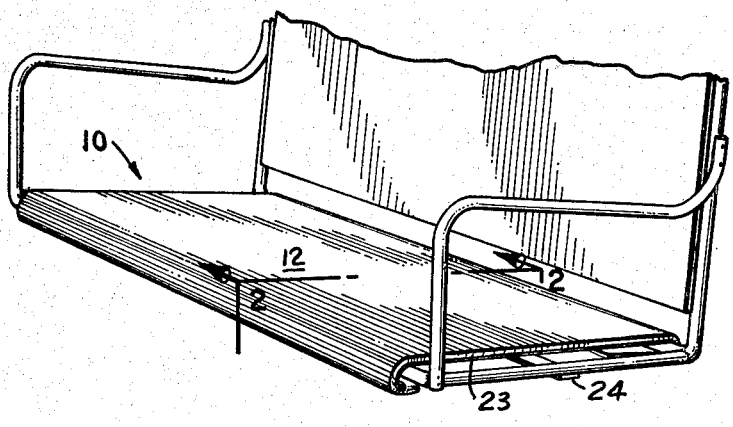
Figure 2:
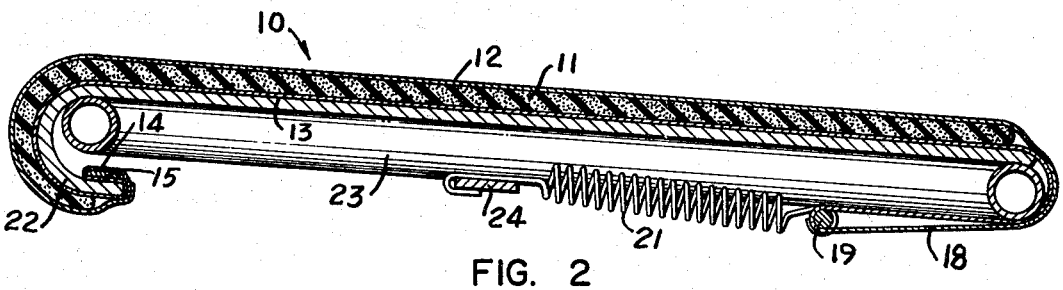
Figure 3:
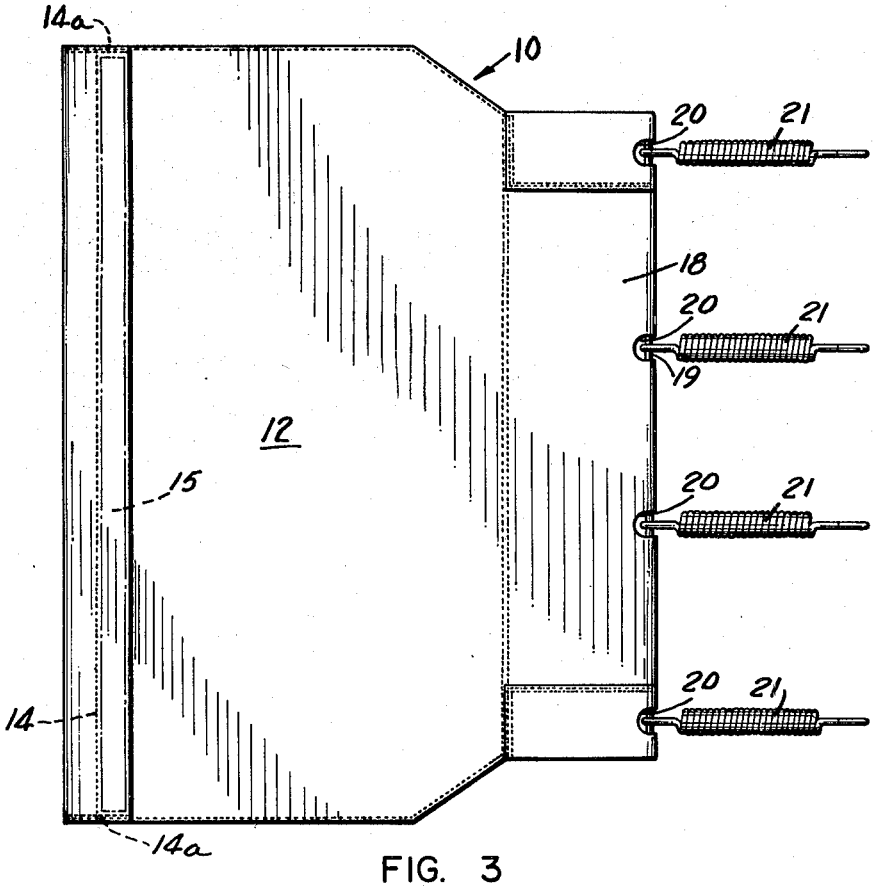

Referring now to the drawing:

In the illustrated preferred embodiment, the cushion 10 for ski lift chairs of the present invention includes a foam pad 11 sized to conform to the flat upper surface of a seat of a ski lift chair. As shown best in FIG. 2, the pad 11 is sandwiched between two layers of vinyl sheet material 12 and 13 that are then sewn together at their edges, around the pad 11. A reversible pocket 14 is formed at one end of the cushion and a flat bar 15 is positioned in the covering of the pocket and extends substantially the full width of the cushion between pocket end walls 14a. The layers of vinyl sheet material are sewn or otherwise attached together to wrap around the bar 15. The opposite end 16 of the cushion is narrowed and the vinyl covers are seamed together at 17 to fully enclose the foam pad 11. A flap 18 formed from the vinyl covers extends from the seam 17 and a rod 19 is inserted into the flap. Openings 20 spaced across the width of the flap 18 provide a means by which hooks of springs 21 can be attached to the rod 19.

In use, the vinyl covered pad 11 is placed on the seat of a conventional ski lift chair such that the pocket 14 extends over a front edge 22 of the seat 23. As shown, the front edge 22 of seat 23 is reversely turned beneath the actual seat portion and the pocket 14 fits over the end 22 with bar 15 above the reversely turned front edge. It will be apparent however that the pocket 14 could as easily fit over a forwardly extending front edge of the seat, with the bar 15 then positioned beneath the front edge of the seat. The bar 15 provides a solid surface to firmly anchor the cushion to edge 22 and distributes stress evenly across the cushion. Flap 18 extends over the back of the seat and is folded back beneath so that the springs 21, that each have one end hooked to bar 19, can have their other ends readily hooked to support slats 24 underneath the seat.

Because the vinyl surface of the cushion is smooth, it facilitates mounting and dismounting by persons using the chair seats. In addition, snow does not stick easily to vinyl, thereby making it easier for a lift operator to knock collected snow from the seat before a user sits thereon.

The rod 19, distributes stress evenly across the width of the cushion and allows the springs 21 to hold the cushion in a stretched taut, smooth condition.

Although a preferred embodiment of my invention has been herein disclosed, it is to be understood that the present disclosure is by way of example and that variations are possible without departing from the subject matter coming within the scope of the following claims, which subject matter I regard as my invention.

I claim:

1. A cushion for ski lift chairs and the like comprising a flat pad of resilient material;

a covering of slick, durable and flexible sheet material entirely covering said pad;

a reversible pocket formed from said sheet material at one end of the pad said pocket being adapted to fit over the front edge of a seat;

a flat bar fully encased in the covering of the pocket and extending substantially the full width of the cushion to hold the pocket flat against the seat edge with a flat surface of the bar holding the covering flat against a flat surface of the seat edge;

a flap formed from the sheet material extending from the opposite end of the pad said flap having a width less than that of the one end of the pad, the edges of said pad being angled to the flap;

a rod inserted into the flat at the end thereof opposite to the pad and extending across the full width of the flap; and spring means connected to and projecting from the rod to be connected to the undersurface of the seat whereby a substantially uniform pull is applied to the flap and the pad.

* * * * *